US010707653B2

(12) United States Patent
Thomson et al.

(10) Patent No.: US 10,707,653 B2
(45) Date of Patent: Jul. 7, 2020

(54) SPARK PLUG

(71) Applicant: Federal-Mogul Ignition LLC, Southfield, MI (US)

(72) Inventors: Nathan Alan Thomson, Plymouth, MI (US); John Antony Burrows, Manchester (GB); Samuel Owen Roe, Manchester (GB)

(73) Assignee: FEDERAL-MOGUL IGNITION LLC, Southfield, MI (US)

( * ) Notice: Subject to any disclaimer, the term of this patent is extended or adjusted under 35 U.S.C. 154(b) by 0 days.

(21) Appl. No.: 16/595,612

(22) Filed: Oct. 8, 2019

(65) Prior Publication Data

US 2020/0119529 A1 Apr. 16, 2020

Related U.S. Application Data

(60) Provisional application No. 62/744,309, filed on Oct. 11, 2018.

(51) Int. Cl.
*H01T 13/20* (2006.01)

(52) U.S. Cl.
CPC ..... *H01T 13/20* (2013.01)

(58) Field of Classification Search
CPC ..... H01T 13/20
See application file for complete search history.

(56) References Cited

U.S. PATENT DOCUMENTS

| | | | |
|---|---|---|---|
| 5,831,377 | A | 11/1998 | Matsubara et al. |
| 7,176,608 | B2 | 2/2007 | Kanao |
| 7,262,547 | B2 | 8/2007 | Klett et al. |
| 7,449,824 | B2 | 11/2008 | Moribe et al. |
| 7,923,910 | B2 | 4/2011 | Nakamura et al. |
| 8,143,773 | B2 | 3/2012 | Suzuki et al. |
| 8,237,343 | B2 | 8/2012 | Hotta et al. |
| 8,294,347 | B2 | 10/2012 | Nakamura et al. |
| 8,432,092 | B2 | 4/2013 | Mori |
| 8,536,770 | B2 | 9/2013 | Kameda et al. |
| 8,624,475 | B2 | 1/2014 | Shimamura et al. |
| 8,643,263 | B2 | 2/2014 | Burrows |
| 8,952,603 | B2 | 2/2015 | Kobayashi |

(Continued)

FOREIGN PATENT DOCUMENTS

| | | | |
|---|---|---|---|
| DE | 102009055397 | A1 | 7/2011 |
| GB | 144962 | A | 6/1920 |
| WO | 2014131705 | A1 | 9/2014 |

*Primary Examiner* — Kevin Quarterman
(74) *Attorney, Agent, or Firm* — Reising Ethington, P.C.

(57) ABSTRACT

A spark plug, including a metallic shell, an insulator, a center electrode, and a ground electrode. The insulator includes a first outer surface at least partly along an exposed portion and a second outer surface at least partly along an unexposed portion. The first outer surface extends between the exposed-unexposed interface to a tip merge portion adjacent a distal end of the insulator. The first outer surface and the second outer surface meet at a nose surface transition. At the nose surface transition, the first outer surface is disposed at a first angle with respect to a central axis of the spark plug, and the second outer surface is disposed at a second angle with respect to the central axis of the spark plug. The first angle is larger than the second angle, and the nose surface transition is located within the unexposed portion or at the exposed-unexposed interface.

20 Claims, 8 Drawing Sheets

(56) References Cited

U.S. PATENT DOCUMENTS

| | | | | |
|---|---|---|---|---|
| 8,981,634 | B2 | 3/2015 | Henke | |
| 9,548,592 | B2 | 1/2017 | Fujino et al. | |
| 9,819,155 | B2 | 11/2017 | Kersting et al. | |
| 2001/0017125 | A1* | 8/2001 | Matsubara | F02P 9/007 123/310 |
| 2005/0052107 | A1 | 3/2005 | Klett | |
| 2005/0057134 | A1* | 3/2005 | Kanao | H01T 13/39 313/141 |
| 2007/0228916 | A1* | 10/2007 | Kunitomo | H01T 13/32 313/143 |
| 2008/0093965 | A1* | 4/2008 | Takada | H01T 13/18 313/143 |
| 2010/0282197 | A1 | 11/2010 | Permuy et al. | |
| 2011/0000453 | A1* | 1/2011 | Kuribayashi | H01T 13/16 123/169 R |
| 2011/0241522 | A1 | 10/2011 | Quitmeyer | |
| 2011/0291543 | A1 | 12/2011 | Lykowski | |
| 2015/0180215 | A1 | 6/2015 | Fujino et al. | |
| 2015/0188293 | A1 | 7/2015 | Ozeki et al. | |
| 2015/0295388 | A1 | 10/2015 | Kobayashi | |
| 2015/0333487 | A1* | 11/2015 | Katsuraya | H01T 13/08 313/142 |

* cited by examiner

SPARK PLUG

REFERENCE TO RELATED APPLICATIONS

This application claims the benefit of U.S. Provisional Application No. 62/744,309 filed Oct. 11, 2018, the contents of which are hereby incorporated by reference in their entirety.

FIELD

The present disclosure generally relates to a spark plug and, more particularly, to a spark plug having an insulator with an increased taper or angled surface along a portion at which the insulator projects past the spark plug shell.

BACKGROUND

When in use, spark plugs experience explosive forces generated from the combustion of fuel within the combustion chamber. These explosive forces are exerted against the portions of the spark plug that project into the combustion chamber, including the exposed portion of the insulator. The unexposed portion of the insulator is held in place by the spark plug shell within a bore of the cylinder head. The explosive forces are exerted against the exposed portion of the insulator while the unexposed portion of the insulator is held in place thereby resulting in a bending moment or force on the insulator, which can result in weakening or fracturing of the insulator.

SUMMARY

According to one embodiment, there is provided a spark plug including: a metallic shell; an insulator at least partially surrounded by the metallic shell; a center electrode disposed within a bore of the insulator; and a ground electrode attached to the metallic shell. The insulator includes a first outer surface at least partly along an exposed portion and a second outer surface at least partly along an unexposed portion. The exposed portion includes a portion of the insulator that extends from an exposed-unexposed interface to a tip of the insulator. The first outer surface extends between the exposed-unexposed interface to a tip merge portion adjacent a distal end of the insulator. The first outer surface and the second outer surface meet at a nose surface transition. At the nose surface transition, the first outer surface is disposed at a first angle with respect to a central axis of the spark plug, and the second outer surface is disposed at a second angle with respect to the central axis of the spark plug. The first angle is larger than the second angle, and the nose surface transition is located within the unexposed portion or at the exposed-unexposed interface.

According to various embodiments, this spark plug may further include any one of the following features or any technically-feasible combination of some or all of these features:

- the second angle is zero such that the second outer surface is parallel to the central axis of the spark plug;
- the second outer surface extends in a parallel fashion for a majority of the unexposed portion;
- the second angle is non-zero such that the first surface forms a first tapered region within the exposed portion of the insulator and the second angle forms a second tapered region within the unexposed portion of the insulator;

- the second outer surface is a variable radius curved surface;
- the insulator includes a third outer surface along the unexposed portion that is angled at a third angle with respect to the central axis of the spark plug, wherein the third angle is not equal to the second angle;
- the third angle is less than the second angle;
- the second angle is less than the third angle and the third angle is less than the first angle;
- a radial distance between the metallic shell and the insulator is greater than or equal to 1 mm and greater than a spark gap formed between the center electrode and the ground electrode, the radial distance being measured along a line that passes through the nose surface transition, the line being orthogonal to the central axis of the spark plug;
- a radial distance between the metallic shell and the insulator is at a maximum when compared to other radial distances taken between the metallic shell and the insulator at the unexposed portion, the radial distance being measured along a line that passes through the nose surface transition and that is orthogonal to the central axis of the spark plug, and the other radial distances being measured along other lines, each of which is parallel to the line that passes through the nose surface transition, the line being orthogonal to the central axis of the spark plug;
- a diameter of the insulator decreases as it extends from the unexposed portion to the exposed portion;
- a gap exists between an interior surface of the metallic shell and the insulator at the unexposed portion;
- the nose surface transition is located at the exposed-unexposed interface;
- the nose surface transition has a circumferential vertex;
- the first outer surface is conical between the nose surface transition and the distal end of the insulator;
- the first angle is between 1° and 30°, inclusive; and/or
- the second angle is between 0° and 15°, inclusive.

According to another embodiment, there is provided a spark plug including: a metallic shell; an insulator at least partially surrounded by the metallic shell; a center electrode disposed within a bore of the insulator; and a ground electrode attached to the metallic shell. The insulator includes a first outer surface at least partly along an exposed portion and a second outer surface at least partly along an unexposed portion. The exposed portion includes a portion of the insulator that extends from an exposed-unexposed interface to a tip of the insulator. The first outer surface and the second outer surface meet at a nose surface transition. The first outer surface is conical between the nose surface transition and a distal end of the insulator. At the nose surface transition, the first outer surface is disposed at a first angle with respect to a central axis of the spark plug, and the second outer surface is disposed at a second angle with respect to the central axis of the spark plug. The first angle is larger than the second angle, and the difference between the first angle and the second angle is between 1° and 20°.

According to another embodiment, the difference between the first angle and the second angle is between 1° and 10°, inclusive.

According to yet another embodiment, there is provided a spark plug including: a metallic shell; an insulator at least partially surrounded by the metallic shell; a center electrode disposed within a bore of the insulator; and a ground electrode attached to the metallic shell. The insulator includes a first outer surface at least partly along an exposed portion, a second outer surface at least partly along an unexposed portion, and a third outer surface at least partly along the unexposed portion. The exposed portion includes a portion of the insulator that extends from an exposed-unexposed interface to a tip of the insulator. The first outer surface and the second outer surface meet at a first nose surface transition, and the second outer surface and the third outer surface meet at a second nose surface transition. At the first nose surface transition, the first outer surface is disposed at a first angle with respect to a central axis of the spark plug, and the second outer surface is disposed at a second angle with respect to the central axis of the spark plug. The first angle is larger than the second angle, and the second nose surface transition is located within the unexposed portion.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION

Figure 1:
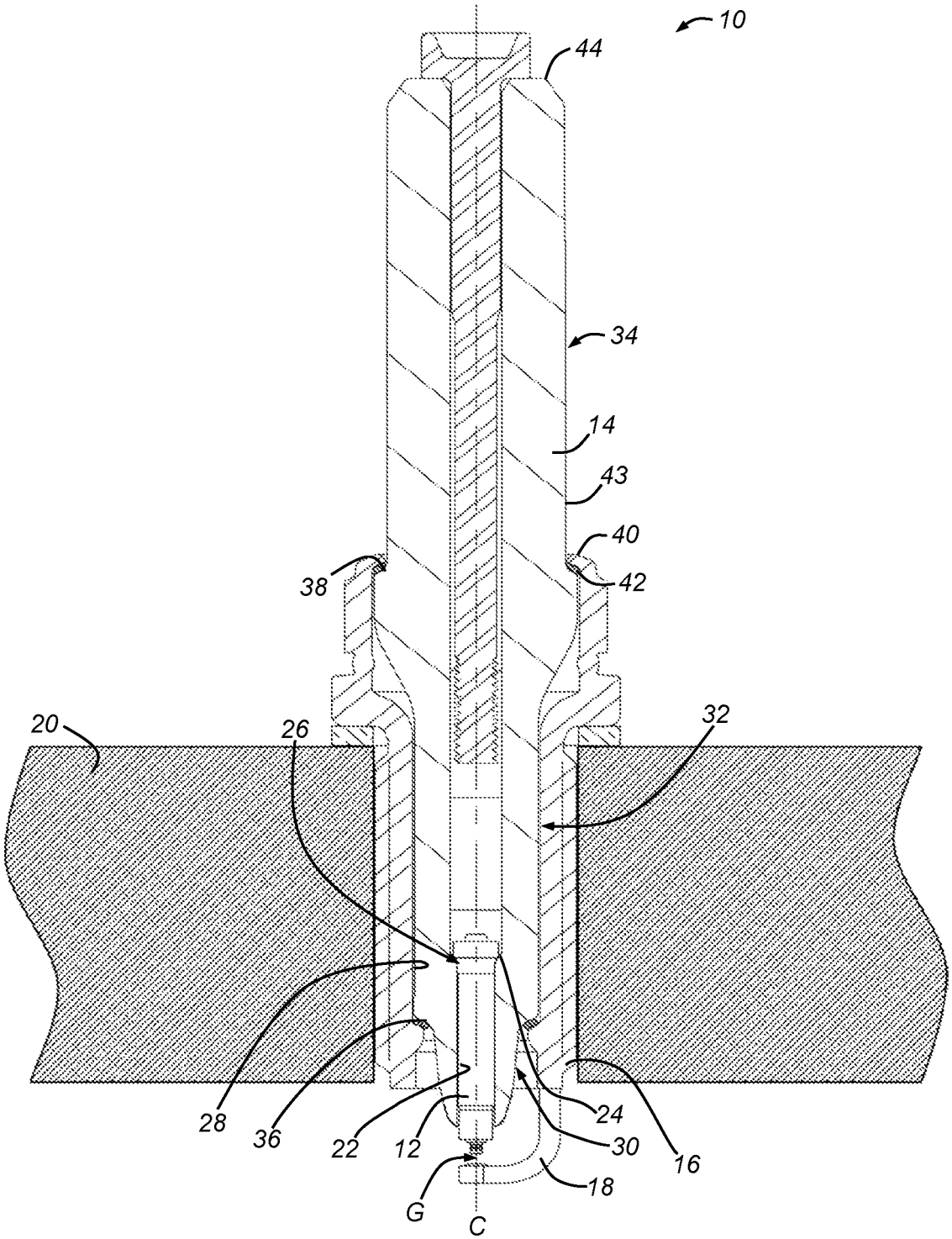
FIG. 1 is a cross-sectional view of an exemplary spark plug as installed in an internal combustion engine (ICE)

The spark plug described herein includes a tapered insulator that includes an additional taper or angled surface at or around a point at which the insulator projects past the spark plug shell (an exposed portion of the insulator). In many embodiments, this additional taper includes a surface that is angled at an angle greater than that of the insulator surface that does not project past the spark plug shell (an unexposed portion of the insulator). This change of angle at the exposed portion along an outer insulator surface enables the insulator to maintain thickness at the unexposed portion within the shell while enabling the exposed portion of the insulator to withstand forces caused from combustion of gas within the combustion chamber. In this way, the insulator can maintain dielectric strength while helping to mitigate damage caused by the explosive forces generated within the combustion chamber.

When a spark plug is in use within an internal combustion engine, the spark plug experiences forces from the combustion of fuel within the combustion chamber, such as explosive forces. These forces act against the insulator (predominantly at the exposed portion of the insulator) and can cause a bending force or moment to be exerted on the insulator, which can lead to weakening or fracturing of the insulator. To combat this bending force, the exposed insulator surface (or at least a portion thereof) can be angled or tapered at an angle with respect to the central axis of the spark plug. The use of an increased or relatively high angle at this exposed insulator surface can result in a smaller exposed cross-sectional area, which refers to a cross-sectional or profiled area that is encountered by a gas flow that is orthogonal to the central axis of the spark plug. In other words, the exposed cross-sectional area coincides with a plane orthogonal to the central axis of the spark plug taken at the main force direction on the insulator core nose. Moreover, use of a larger angle for this exposed insulator surface causes a larger proportion of the explosive forces to be directed upward in a compressive manner thereby combating the bending forces experienced by the insulator. Thus, the larger the angle of the exposed insulator surface, the more the forces are distributed into a compressive force and less the forces are distributed into a bending force. And, in general, use of this larger angle (and, thus, smaller exposed cross-sectional area) can result in less of the overall force being applied to the insulator. In at least some embodiments, in order to maximize this angle without reducing the mechanical, electrical, and thermal performance of the insulator, it is advantageous to maintain the diameter of the insulator at all locations inside the shell. Therefore, in one embodiment, provided a set internal bore thickness or diameter of the metal shell, the thickness of the insulator at the unexposed portion should not be angled at the relatively high angle of the exposed insulator portion since doing so would result in the insulator having to be unacceptably thin, which would result in a commensurate fall in mechanical, thermal, and especially electrical performance. However, outside the grounded metallic shell, these considerations become secondary to the forces applied by gas motion and an increase in angle is desirable. Thus, at least according to one embodiment, the result is that it is beneficial to have a change in angle as the insulator passes through the end of the shell, where the angle at the exposed portion of the insulator is higher than at the unexposed portion.

With reference to FIG. 1, there is shown a spark plug 10 that includes a center electrode 12, an insulator 14, a metallic shell 16, and a ground electrode 18. The spark plug 10 is depicted as installed within a cylinder head 20 of an internal combustion engine (ICE). The center electrode 12, which can be a single unitary component or can include a number of separate components, is at least partially disposed or located within an internal bore 22 of the insulator 14 that extends along the axial length of the insulator 14. As illustrated, the internal bore 22 includes one or more internal step portions 24 that circumferentially extend around the inside of the bore and are designed to receive complementary external step portions 26 of the center electrode 12. In the exemplary embodiment of FIG. 1, the internal bore 22 only includes a single internal step or shoulder portion 24; however, it is possible for the internal bore to include additional internal step portions at different axial positions along the length of the bore or may not include any internal step portions at all. The insulator 14 is at least partially disposed within an internal bore 28 of the metallic shell 16, and the internal bore 28 extends along the length of the metallic shell and is generally coaxial with the internal bore 22. In the particular embodiment shown, the insulator 14 partially extends from and protrudes beyond the end of the metallic shell internal bore 28, and a tip end of the center electrode 12 extends from and protrudes beyond the insulator internal bore 22.

Figure 2:
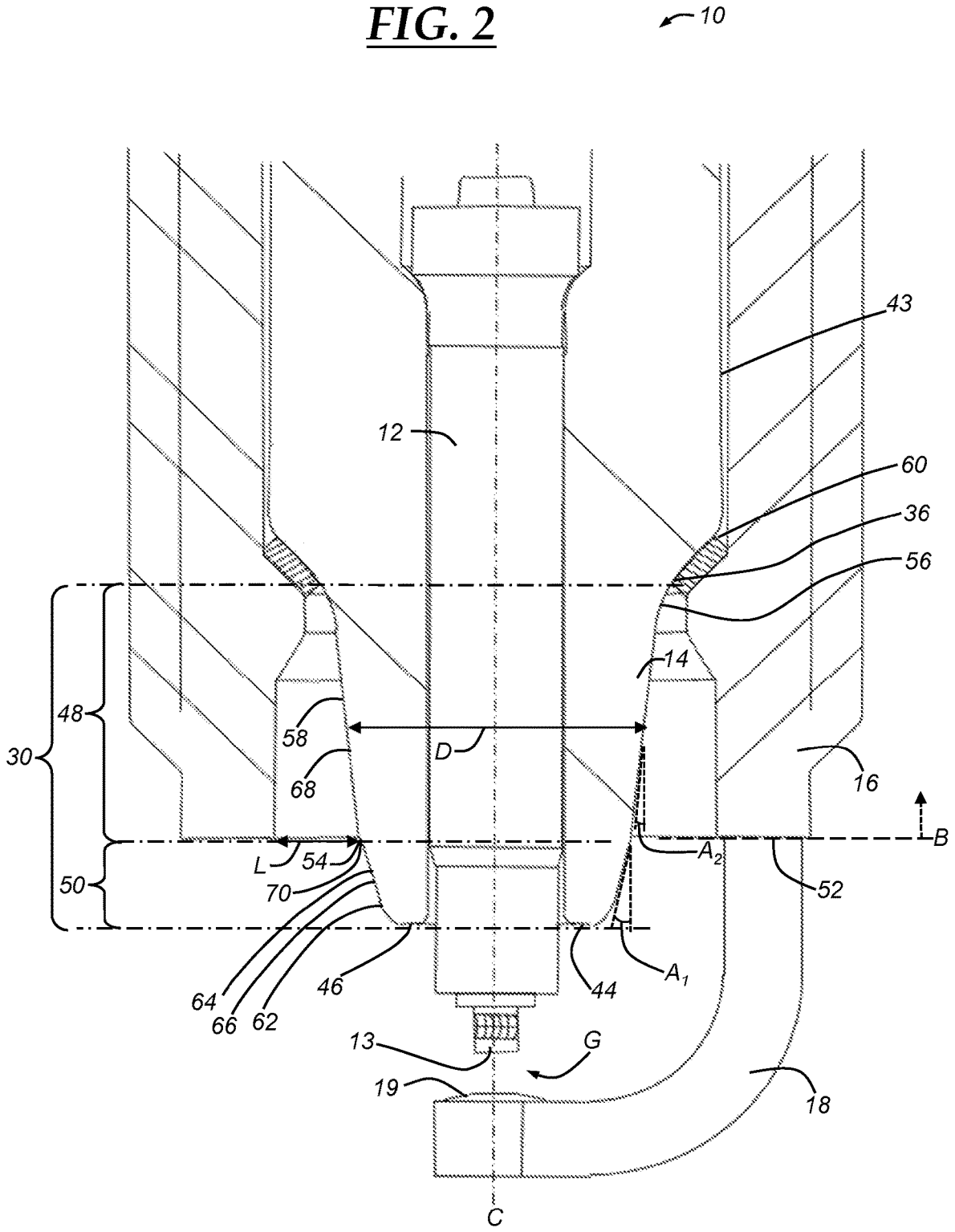
FIG. 2 is a cross-sectional view of an end portion of the exemplary spark plug of FIG. 1.

The center electrode 12 projects past the shell 16 of the spark plug 10 and includes a tip 13 (FIG. 2). The tip 13 of the center electrode 12 forms a spark gap G with a corresponding tip 19 (FIG. 2) of the ground electrode 18. In the embodiment of FIGS. 1 and 2, both the center and ground electrode tips 13, 19 are precious metal firing elements, but this is optional and is not required. The ground electrode 18 extends off the end of the metal shell 16 and projects past an end of the insulator 14. In this example the ground electrode 18 forms a J-gap with the center electrode 12, but other ground electrode configurations are possible. The spark gap G is formed such that the spark follows a path between the center electrode tip 13 and the ground electrode tip 19.

The insulator 14 is an elongated and generally cylindrical component that is made from an electrically insulating material and is designed to isolate the center electrode 12 from the metallic shell 16 so that high-voltage ignition pulses in the center electrode are directed to the spark gap G. The insulator 14 may be comprised of any operable ceramic-based material, and in one embodiment, includes an alumina ($Al_2O_3$) based ceramic material. Alumina-based ceramics in particular tend to have relatively high mechanical and dielectric strength, as well as high electrical resistivity and low dielectric loss, and are known to retain these properties over a relatively wide temperature range.

The insulator 14 includes a nose portion 30, an intermediate portion 32, and a terminal portion 34; however, other configurations or embodiments may be implemented. The intermediate portion 32 of the insulator extends in the axial direction between an external step 36 and an external locking feature 38. In the particular embodiment illustrated in FIG. 1, the majority of the intermediate portion 32 is located and retained within the internal bore 28 of the metallic shell 16. The external locking feature 38 may have a diametrically-enlarged shape so that during a spark plug assembly process an open end or flange 40 of the metallic shell can be folded over or otherwise mechanically deformed in order to securely retain the insulator 14 in place. The folded flange 40 also traps an annular seal or gasket 42 in between an exterior surface 43 of the insulator 14 and an interior surface of the metallic shell 16 so that a certain amount of sealing is achieved. In another embodiment, gasket 42 may include one or more metallic gaskets and optionally include a compacted powder seal. Other intermediate portion features are certainly possible as well.

The terminal portion 34 is at the opposite end of the insulator 14 as the nose portion 30 and the terminal portion 34 extend in the axial direction between the external locking feature 38 and a distal end 44. In the illustrated embodiment, the terminal portion 34 is quite long; however, it may be shorter and/or have any number of other features, like annular ribs. The spark plug 10 is not limited to the illustrated embodiment and may utilize any combination of other known spark plug components, such as terminal studs, internal resistors, internal seals, various gaskets, precious metal elements, etc., to cite a few of the possibilities. It should be pointed out that spark plug 10 is simply a non-limiting example of a plug that may utilize the insulator described herein. The insulator may be used with any number of other types of spark plugs and/or ignitors, such as, but not limited to, those having: J-gap, annular, single gap, multi gap and/or other types of spark gap arrangements; precious metal tips on both the center and ground electrodes, precious metal tips on only one of the center or ground electrodes, no precious metal tips, multi piece precious metal tip assemblies, single piece precious metal tips, precious metal pieces in the form of rivets, rods, cylinders, disks, pads, protrusions, annular rings, annular sleeves and/or other embodiments; as well as any other suitable spark plug and/or ignitor configuration. The insulator described herein is not limited to any particular spark plug or ignitor.

FIG. 2 is an enlarged view of the nose portion 30 of the spark plug 10. The nose portion 30 of the insulator 14 extends in the axial or longitudinal direction between a nose root portion 56 on the exterior surface 43 of the insulator and a tip 46 of the insulator 14. The nose portion 30 includes an unexposed portion 48 and an exposed portion 50. The unexposed portion 48 is the part of the nose portion 30 that is within the bore of the shell 16, which can be that portion of the nose portion 30 that extends from the external step 36 to a plane B, as shown in FIG. 2. The plane B can be coplanar with the end 52 of the shell 16. The exposed portion 50 of the nose portion 30 is the part of the nose portion 30 that extends from the end 52 of the shell 16 (or the plane B) to the nose tip 46 of the nose portion 30. In this way, the exposed portion 50 is the part of the nose portion 30 that extends into the combustion chamber (when the spark plug 10 is in use) beyond the shell 16. In some instances, the exposed portion 50 can be referred to as the "projection" of the nose portion 30. An interface or region between the unexposed portion 48 and the exposed portion 50 is referred to as an exposed-unexposed interface 54. There may be some slight variations as to the exact location of the exposed-unexposed interface 54 on the insulator. For example, the insulator 14 may settle against the internal gasket, which can become compressed over time, such that the location where the exposed-unexposed interface 54 lines up on the insulator changes slightly. To address this, instead of the exposed-unexposed interface 54 being deemed a planar boundary located exactly between the exposed and unexposed portions 50, 48 of the insulator, directly at the distal end 52 of the shell 16, the exposed-unexposed interface 54 is considered a small axially extending region or area on the insulator that is located within a tolerance amount (e.g., ± one millimeter, ± two millimeters), along the central axis C, of plane B, which in turn is coplanar with the end 52 of the shell 16. Unless stated otherwise, the tolerance amount used herein is ±two millimeters. Thus, a nose surface transition 70 at the exposed-unexposed interface 54 may occur somewhere within two millimeters from the distal end 52 of the shell 16. In one particular embodiment, the nose surface transition 70 occurs at an exposed-unexposed interface 54 that is 1.75 mm below the distal end 52 of the shell 16 (closer to the center of the combustion chamber). In another embodiment, as illustrated more particularly in the figures, the nose surface transition 70 at the exposed-unexposed interface 54 occurs directly at the distal end 52 of the shell 16.

A radial distance L between the interior surface of the shell 16 and the exterior surface of the insulator 14 (such as at the exposed-unexposed interface 54 or at the nose surface transition 70) can be greater than 1 mm (millimeter), or in some embodiments can be equal to 1 mm. Additionally, at least in some embodiments, a radial distance L taken at the exposed-unexposed interface 54 (or at the nose surface transition 70) can be greater than the spark gap G. The radial distance L can be greatest at the exposed-unexposed interface 54 (or the end 52 of the shell 16) when compared to a radial distance taken at any other point of the unexposed portion 48 along an outer surface of the insulator. And, the radial distance L can be smallest at the exposed-unexposed interface 54 (or nose surface transition 70) when compared to any other radial distances taken between the ground electrode and the insulator at any other point of the exposed portion 50 along an outer surface of the insulator. In such a case, these radial distances are measured along an axis orthogonal to the central axis C (i.e., along a radial direction with respect to the central axis C). Although the radial distance is typically used to describe a distance between an interior surface of the metallic shell 16 and an exterior surface of the insulator 14, there may be axial locations in which the metallic shell 16 is not present, such as axial locations that correspond to the exposed portion 50. In such instances, the radial distance can be measured in a radial direction between an exterior surface of the insulator 14 and an interior surface of the ground electrode 18.

Also, as shown in FIG. 2, the radial distance L is not at a local minimum at the exposed-unexposed interface 54 (or nose surface transition 70); that is, the radial distance L at the exposed-unexposed interface 54 (or nose surface transition 70) is not smaller than both an adjacent unexposed radial distance and an adjacent exposed radial distance. The adjacent unexposed radial distance is a radial distance (i.e., a distance taken in a radial direction with respect to the central axis C) taken between an interior surface of the shell 16 and an exterior surface of the insulator 14 at a point adjacent to the exposed-unexposed interface 54 and within the unexposed portion 48. The adjacent exposed radial distance is a radial distance taken between an interior surface of the ground electrode 18 and an exterior surface of the insulator 14 at a point adjacent to the exposed-unexposed interface 54 and within the exposed portion 50. The adjacent unexposed radial distance and the adjacent exposed radial distance are measured along separate lines, each of which is radial with respect to the central axis C. Additionally, the insulator 14 includes a diameter D that decreases (or at least does not increase or does not remain constant) as the insulator extends from the unexposed portion (and/or the nose root portion 56) to the exposed portion (and/or the nose tip 46).

The exposed portion 50 of the nose portion 30 of the spark plug 10 is exposed to the combustion chamber, as well as thermal and mechanical forces therein. The thickness of the insulator 14 may be set at every point to meet the mechanical strength, thermal behavior, and dielectric strength of the system in which the insulator 14 (or spark plug 10) is to be used. In many instances, setting the thickness of the insulator 14 results in a tradeoff between the dielectric strength of the insulator 14 (such as at portions that are inside the shell 16) and the forces generated by gas motion acting on the nose portion 30, particularly at the exposed portion 50 of the nose portion 30. In some instances, use of a thicker insulator 14 enables the insulator 14 to withstand higher mechanical and electrical loads, but also results in an increased exposed cross-sectional area, which can result in increased bending forces since the area exposed to the combustion forces is greater. The exposed cross-sectional area refers to the cross-sectional or profiled area of the exposed portion 50 taken (or sliced) at the center of the insulator 14 when viewed in the radial direction, such as that which is shown in FIG. 2.

The extent to which the nose portion 30 axially extends or protrudes beyond the end of the metallic shell 16 may be greater or less than that shown in FIG. 1. As shown in FIG. 2, the nose portion 30 can be conical (or substantially conical) with respect to the central axis C of the spark plug 10. The central axis C of the spark plug 10 can be taken with respect to the center longitudinal axis of the internal bore 28 of the shell 16, or may be taken with respect to the internal bore 22 of the insulator 14. And, in particular, the unexposed portion 48 and the exposed portion 50 can both be conical (or substantially conical). This conical shape is advantageous, particularly with the exposed portion 50, as it can provide for an improved response to applied bending forces. However, in other embodiments, the unexposed portion 48 and the exposed portion 50 can each or both have a different configuration, such as fixed radius curved, variable-radius curved, multi-part shaped, or any combination thereof. Some of these various embodiments are discussed in more detail below, such as in FIGS. 5 to 8.

The unexposed portion 48 of the nose portion 30 includes a nose root portion 56 and an unexposed body portion 58. The nose root portion 56 serves as a transition from the external step (or gasket seat) 36 of the insulator 14 and the unexposed body portion 58, and can serve as a first end of the nose portion 30. The external step 36 can be or can include a surface for abutting an internal gasket 60 that seals off the internal bore 28 of the shell 16 so as to prevent gases from the combustion chamber from entering the internal bore 28 when the spark plug 10 is in use.

The exposed portion 50 of the nose portion 30 includes the nose tip 46, a tip merge portion 62, and an exposed body portion 64. The nose tip 46 can include a surface that is orthogonal (or substantially orthogonal) to the central axis C. The nose tip 46 projects into the combustion chamber and beyond the shell 16. In many instances, this projection enables a well-formed spark to be generated at the spark gap G so as to provide a suitable ignition source for the fuel and air mixture in the combustion chamber. The surface of the exposed body portion 64 merges into the nose tip 46 at the tip merge portion 62, which is a rounded or radiused surface disposed between the exposed body portion 64 and the nose tip 46. In other embodiments, the tip merge portion can be omitted and a hard edge can be formed between the exposed body portion 64 and the nose tip 46. Other implementations of the nose tip 46 and tip merge portion 62 may be used.

The nose portion 30 includes a first outer surface 66 and a second outer surface 68. In many embodiments, the first outer surface 66 includes at least part of the exposed body portion 64 and the second outer surface 68 includes at least part of the unexposed body portion 58. And, in the depicted embodiment, the first outer surface 66 coincides with the exposed body portion 64 and the second outer surface 68 coincides with the unexposed body portion 58. Moreover, the first outer surface 66 (and also the exposed body portion 64) is angled or slanted at a first angle $A_1$ with respect to the central axis C of the spark plug 10 and, thus, can be referred to as a first angled surface. Also, the second outer surface 68 (and also the unexposed body portion 58) is angled or slanted at a second angle $A_2$ with respect to the central axis C of the spark plug 10 and, thus, can be referred to as a second angled surface. At least in this embodiment, the first angle $A_1$ can be referred to an exposed nose angle $A_1$ and the second angle $A_2$ can be referred to an unexposed nose angle $A_2$. As shown in the depicted embodiment, the exposed nose angle $A_1$ is larger than the unexposed nose angle $A_2$ and, thus, the nose portion 30 includes a positive change of angle $\Delta A_{1,2}$. The change of angle $\Delta A_{1,2}$ is the difference between the exposed nose angle (or first angle) $A_1$ and the unexposed nose angle (or second angle) $A_2$, which can be expressed as $(A_1-A_2)$. This change of angle $\Delta A_{1,2}$ can be positive as shown in the depicted embodiment. In general, the angle of the insulator surface at the transition 54 increases from the unexposed region to the exposed region, and this transition occurs largely coplanar with the end 52 of the shell 16. Advantageously, in many embodiments, neither the first outer surface 66 nor the second outer surface 68 are parallel with the central axis C.

As discussed above, the nose portion 30 of the insulator 14 is tapered at both the unexposed portion 48 and the exposed portion 50. The exposed body portion 64 (or the exposed portion 50) is shown as having a continuous and uniform taper along its axial extent, and is angled at the exposed nose angle $A_1$. Similarly, the unexposed body portion 58 (or the unexposed portion 48) is shown as having a continuous and uniform taper along its axial extent, and is angled at the unexposed nose angle $A_2$. In many embodiments, the unexposed body portion 48 is non-tangential with the exposed body portion 50. This arrangement can maximize insulator volume at the unexposed portion 48 while improving bending strength at the exposed portion 50, particularly compared to exposed portions that have exposed surfaces that are generally parallel or in line with the central axis C.

The angle of the nose portion 30 abruptly transitions from the exposed nose angle $A_1$ to the unexposed nose angle $A_2$ at the exposed-unexposed interface 54, and this transition can be referred to as a nose surface transition 70. Thus, in this depicted embodiment, the exposed-unexposed interface 54 coincides with the nose surface transition 70 and includes a circumferential vertex (or sharp edge). In many embodiments, this circumferential vertex extends outwardly or is convex with respect to the outer surface of the insulator, as opposed to transitions at the exposed-unexposed interface that have a more concave configuration. In other embodiments, the nose surface transition 70 between the exposed nose angle $A_1$ and the unexposed nose angle $A_2$ can be gradual and, in particular, can be radiused or rounded. Moreover, in alternative embodiments, the nose surface transition 70 between the exposed nose angle $A_1$ and the unexposed nose angle $A_2$ can include a filet, chamfer, multiple sharp edges, or the like. In other embodiments, another nose surface transition can occur at a point other than the exposed-unexposed interface 54. For example, a nose surface transition can occur at a point within the shell 16 and/or at a point within the unexposed body portion 58. Or, a nose surface transition can occur at a point outside the shell 16 and at a point within the exposed body portion 64. And, in other embodiments, a plurality of nose surface transitions can be used.

In some instances, the unexposed nose angle $A_2$ is slight or small (and, in some cases, zero) so that the thickness of the insulator 14 at the unexposed portion 48 can be sufficiently thick to withstand forces exerted during engine operation as well as maintain dielectric integrity between the ground electrode 18 and the center electrode 12 so as to prevent electrical failure of the spark plug 10. Moreover, in various embodiments, the length of the unexposed portion 48 can be extended and, in such cases, using a small (or zero) unexposed nose angle $A_2$ along the unexposed body portion 58 can maintain insulator thickness. Moreover, other requirements may be factored into the setting or selection of insulator thickness and/or unexposed nose angle $A_2$, including shell thread diameter.

Figure 3:
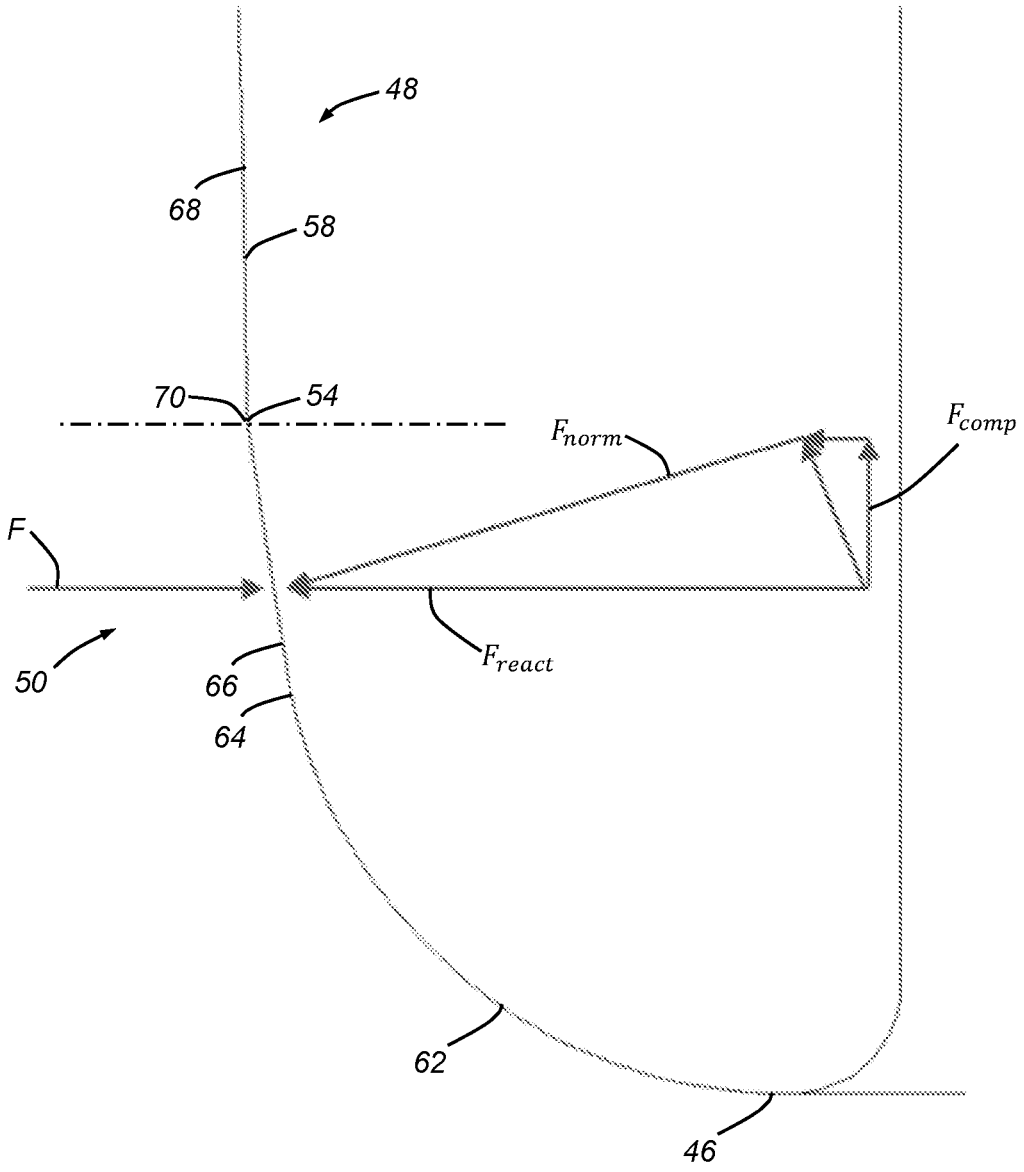
FIG. 3 is a diagram outlining forces that can be experienced by the spark plug of FIG. 1 when used in an internal combustion engine.

With reference to FIG. 3, there is shown a diagram outlining forces that can be experienced by the spark plug 10 when used in an internal combustion engine. A force F, such as an explosive force generated by combustion of an air-fuel mixture, may be exerted to the insulator 14 at the exposed portion 50. This force F is equal to the reaction force $F_{react}$, which can be resolved into its orthogonal components including a compression force $F_{comp}$ and a reaction normal force $F_{norm}$. In many instances, the magnitude of the compressive force $F_{comp}$ is dependent upon the angle $A_1$ of the exposed body portion 64 and, in particular, the magnitude of the compressive force $F_{comp}$ increases as the angle $A_1$ increases. And, in such instances, this larger compressive force $F_{comp}$ acts to reduce the tensile force that is exerted at the nose root portion 56 (FIG. 2). As mentioned above, this additional taper (or first outer surface 66) at the exposed portion 50 of the nose portion 30 enables the exposed nose portion 50 to be angled at a greater (or significant) angle relative to the unexposed portion 60 thereby allowing the insulator 14 to maintain its dielectric strength at portions within the shell 16 while reducing the chances of potential damage to the insulator 14 (such as at the nose root portion 56) due to explosive forces experienced by the exposed portion 50.

Figure 4:
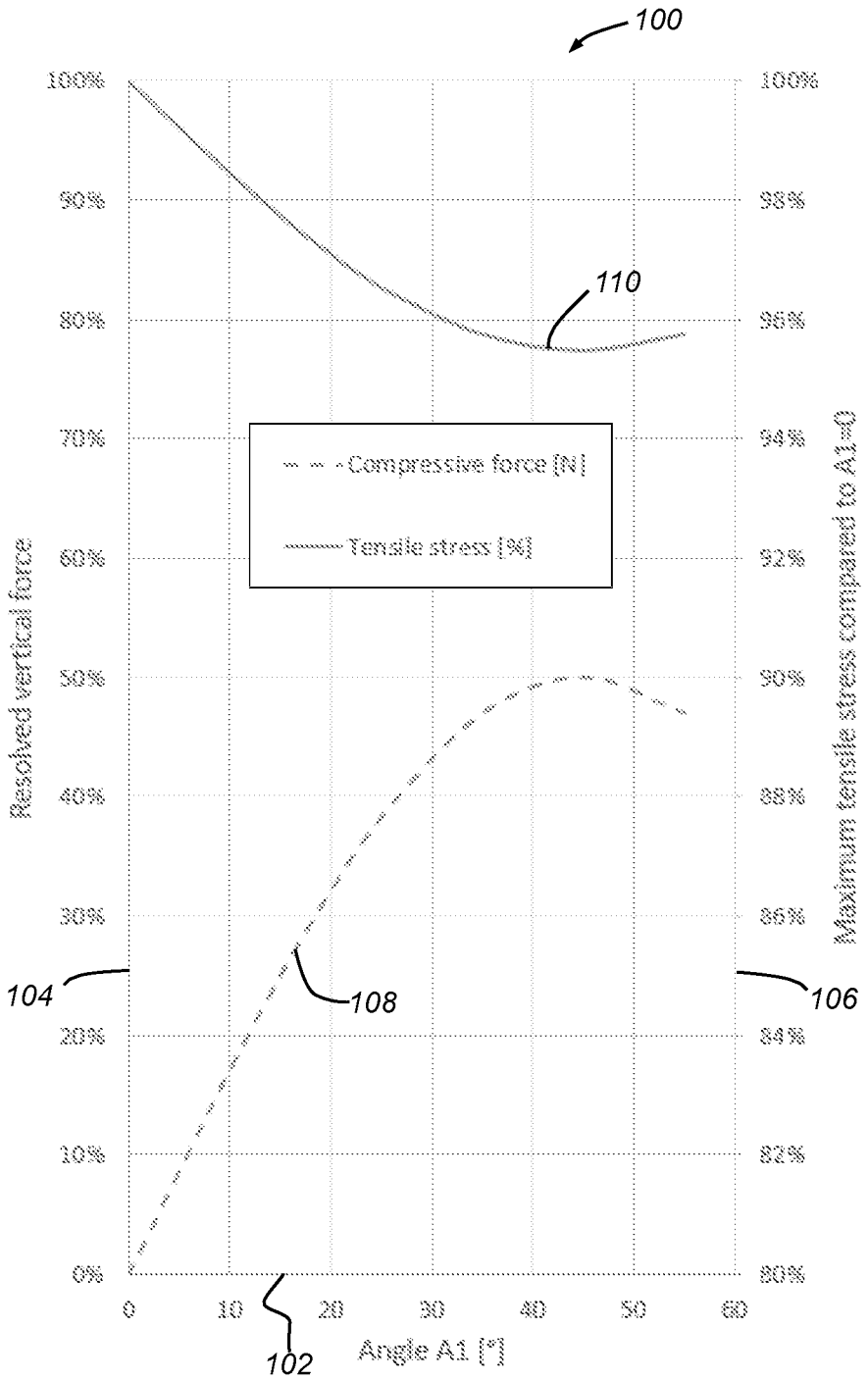
FIG. 4 is a graph representing relative magnitudes of compressive forces and tensile stresses experienced by an insulator during testing in which mechanical forces were applied to various insulators at an exposed portion with an angled surface.

With reference to FIG. 4, there is shown a graph 100 representing compressive forces $F_{comp}$ and tensile stress experienced by the insulator 14 during a testing in which mechanical forces were applied to the insulator 14 at the exposed portion 50. The graph 100 includes an x-axis 102 representing the first angle $A_1$ of the exposed body portion 64, a first y-axis 104 representing the compressive force $F_{comp}$ as a proportion of the applied force F, and a second y-axis 106 representing the maximum tensile stress compared to simulations with the first angle $A_1$ being zero. The dashed line 108 corresponds to the first y-axis 104 and the solid line 110 corresponds to the second y-axis 106. As mentioned above, in many instances, the tensile stress is a function of the compressive force $F_{comp}$, which ultimately is a function of the first angle $A_1$. The line 108 illustrates that a maximum $F_{comp}$ is experienced when the first angle $A_1$ is at or around 45°. Moreover, the minimum tensile stress at the nose root portion 56 is experienced when the first angle $A_1$ is at or around 45°. In one embodiment, the insulator 14 includes a first outer surface that is angled at a first angle $A_1$ that is between 30° and 50°. In another embodiment, the insulator 14 includes a first outer surface that is angled at a first angle $A_1$ that is between 40° and 50°. In yet another embodiment, the insulator 14 includes a first outer surface that is angled at a first angle $A_1$ that is 45°. Additionally, in one embodiment, the insulator 14 includes a change of angle $\Delta A_{1,2}$ that is between 1° and 30°. In another embodiment, the insulator 14 includes a change of angle $\Delta A_{1,2}$ that is between 1° and 20°. In yet another embodiment, the insulator 14 includes a change of angle $\Delta A_{1,2}$ that is between 1° and 10°. Although having the first angle $A_1$ be between 30° and 50° can assist in minimizing the tensile stress, it may be advantageous to maintain a larger diameter at the exposed portion so as to provide more strength to the insulator 14. Thus, according to some embodiments, the first angle $A_1$ can be between 1° and 30°, inclusive, and preferably between 5° and 20°, inclusive. Additionally or alternatively, in some embodiments, the second angle $A_2$ can be between 0° and 15°, inclusive, and preferably between 0° and 12°, inclusive.

As mentioned above, the exposed cross-sectional area is a function of the first angle $A_1$ such that as the first angle $A_1$ is increased, the exposed cross-sectional area is decreased. As mentioned above, the exposed cross-sectional area refers to a cross-sectional or profiled area that is encountered by a gas flow that is orthogonal to the central axis of the spark plug. In many instances, the force F experienced by the insulator 14 is reduced as the exposed cross-sectional area is reduced. Thus, by increasing the first angle (or exposed nose angle) $A_1$ (and, thus, reducing the exposed cross-sectional area), the force F experienced is reduced.

With reference to FIGS. 5 through 8, there are shown other embodiments of an insulator 314, 414, 514, 614 that can be used with the spark plug 10. These insulators 314, 414, 514, 614 can be the same or similar to the insulator 14, to the extent that such discussion of the insulator 14 is not inconsistent with the discussion of insulators 314, 414, 514, 614 below.

Figure 5:
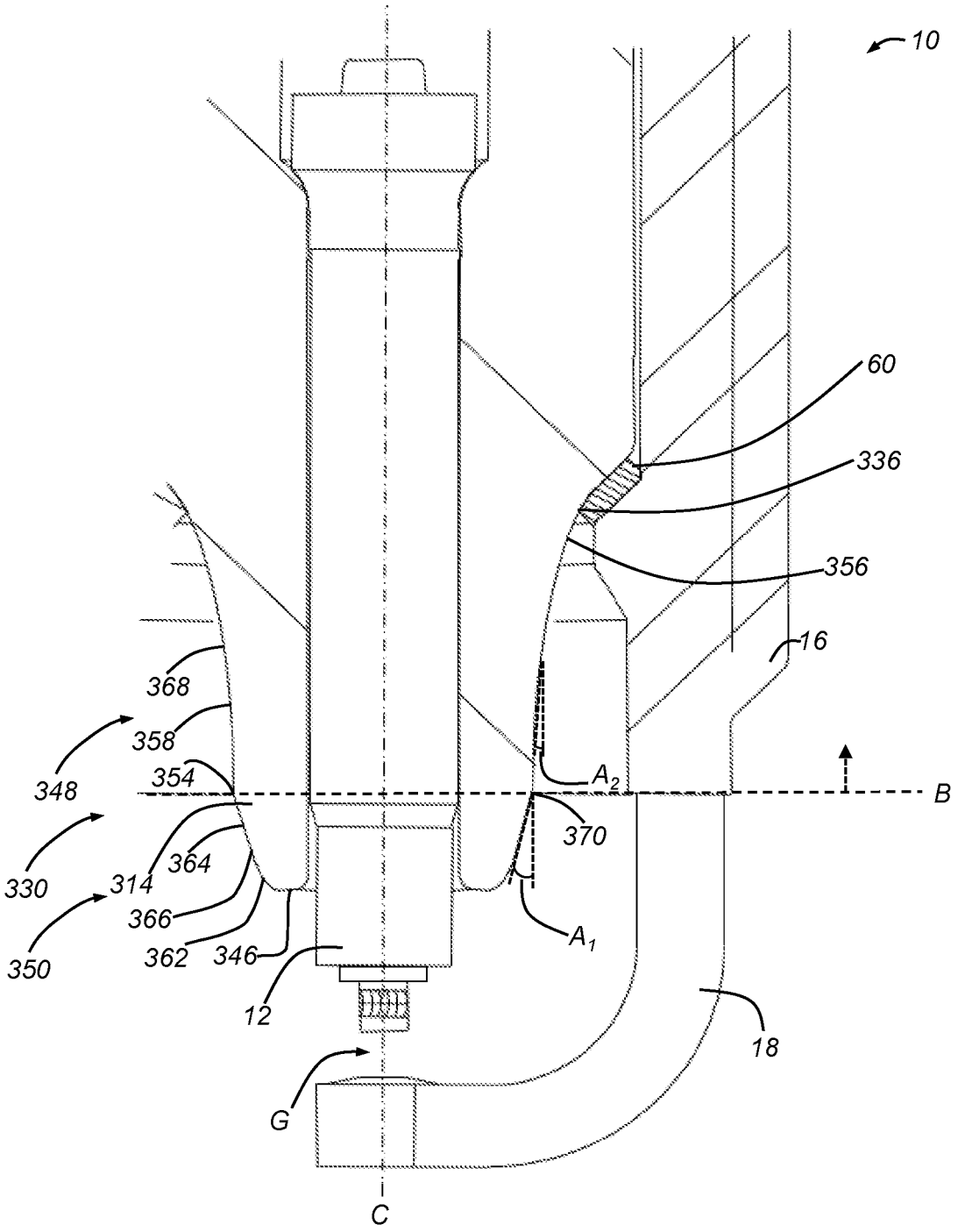
FIG. 5 is a cross-sectional view of a second embodiment of a spark plug with an exemplary insulator.

With particular reference to FIG. 5, there is shown an insulator 314 that can be used with the spark plug 10. The insulator 314 includes a nose portion 330 and the nose portion 330 includes an unexposed portion 348 and an exposed portion 350. The exposed portion 350 of the insulator 314 includes a nose tip 346, a tip merge portion 362, and an exposed body portion 364. The unexposed portion 348 includes an unexposed body portion 358 that has a variable radius curve. As used herein, "variable radius curve" refers to a surface that is curved between varying radiuses, such as in an elliptical or non-circular fashion. Moreover, the unexposed body portion 358 gradually merges into the nose root portion 356, which then merges into the external step 336.

The nose portion 330 includes an exposed-unexposed interface 354 at which a nose surface transition 370 takes place between a first outer surface 366 and a second outer surface 368. The first outer surface 366 can be angled or slanted at a first angle $A_1$ and the second outer surface 368 can be angled or slanted at a second angle $A_2$. It should be appreciated that, at least in the depicted embodiment, the first outer surface 366 coincides with (and, thus, at least partially includes) the exposed body portion 364 and the second outer surface 368 coincides with (and, thus, at least partially includes) the unexposed body portion 358. Thus, in this embodiment, the second outer surface 368 at the nose surface transition 370 is parallel to the central axis C and the second outer surface 368 is angled at a non-zero angle at a portion located near the nose root portion 356. However, in other embodiments, the nose surface transition 370 can be disposed within either the unexposed portion 348 or the exposed portion 350. In such cases, the first outer surface 366 or the second outer surface 368 can include the exposed-unexposed interface 354.

Figure 6:
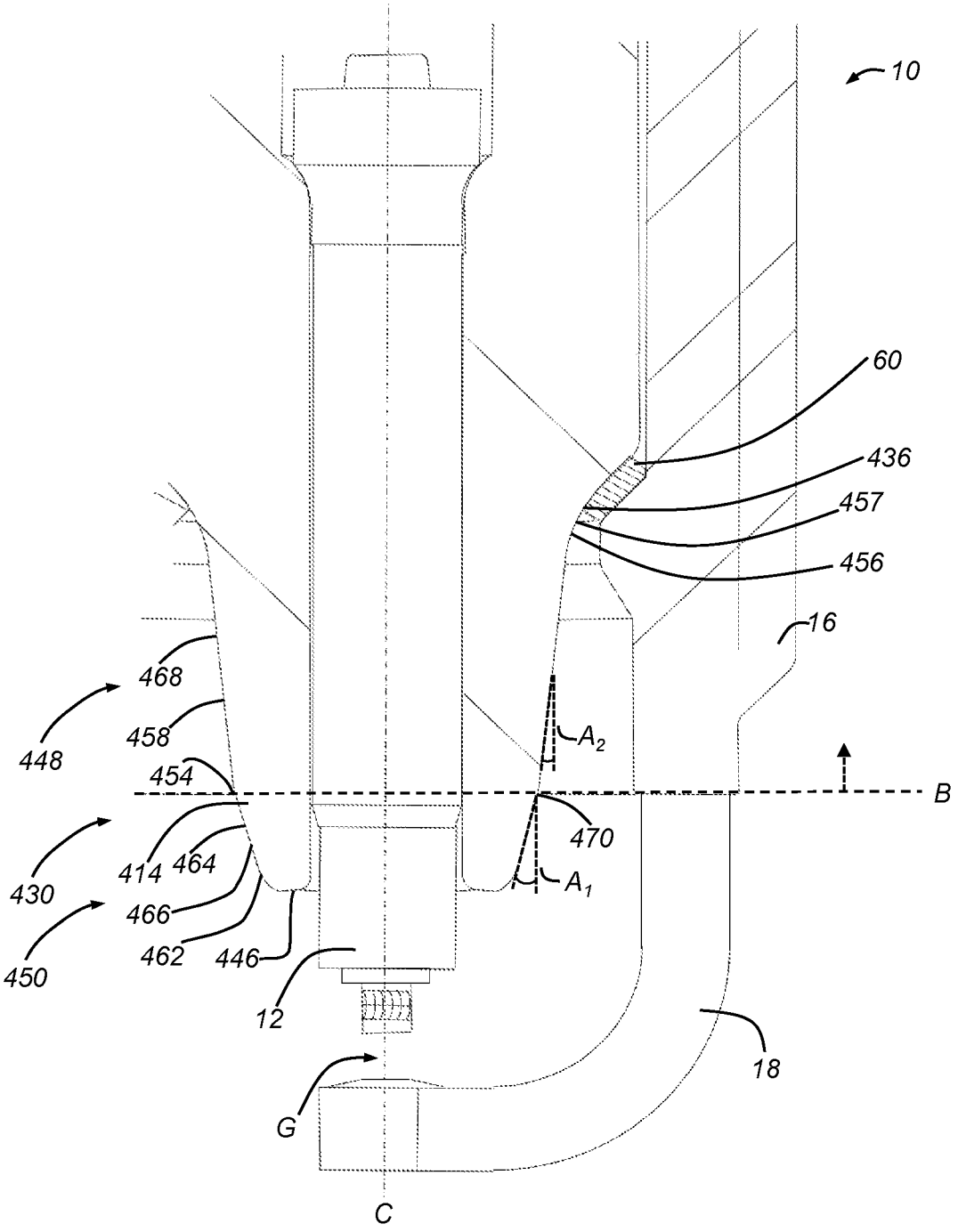
FIG. 6 is a cross-sectional view of a third embodiment of a spark plug with an exemplary insulator.

With particular reference to FIG. 6, there is shown an insulator 414 that can be used with the spark plug 10. The insulator 414 includes a nose portion 430 and the nose portion 430 includes an unexposed portion 448 and an exposed portion 450. The unexposed portion 448 includes an unexposed body portion 458 and a nose root portion 456. The exposed portion 450 includes a nose tip 446, a tip merge portion 462, and an exposed body portion 464. The exposed body portion 464 can be slanted or angled at a first angle $A_1$. The exposed portion 450 includes a first outer surface 466 that is slanted at the first angle, which can be referred to as an expose nose angle $A_1$ at least in this embodiment.

The nose portion 430 includes an exposed-unexposed interface 454 at which a nose surface transition 470 takes place between the first outer surface 466 and a second outer surface 468. The first outer surface 466 can be angled or slanted at the first angle $A_1$ and the second outer surface 468 can be angled or slanted at a second angle $A_2$. It should be appreciated that, at least in the depicted embodiment, the first outer surface 466 coincides with (and, thus, at least partially includes) the exposed body portion 464 and the second outer surface 468 coincides with (and, thus, at least partially includes) the unexposed body portion 458. However, in other embodiments, the nose surface transition 470 can be disposed within either the unexposed portion 448 or the exposed portion 450. In such cases, the first outer surface 466 or the second outer surface 468 can include the exposed-unexposed interface 454. In this embodiment, the second outer surface 468 merges into the nose root portion 456 in a gradual fashion. Moreover, the nose root portion 456 gradually merges into an external step 436 and includes a surface 457 with a radius of curvature that is larger than that of the insulator 14 of FIG. 2.

Figure 7:
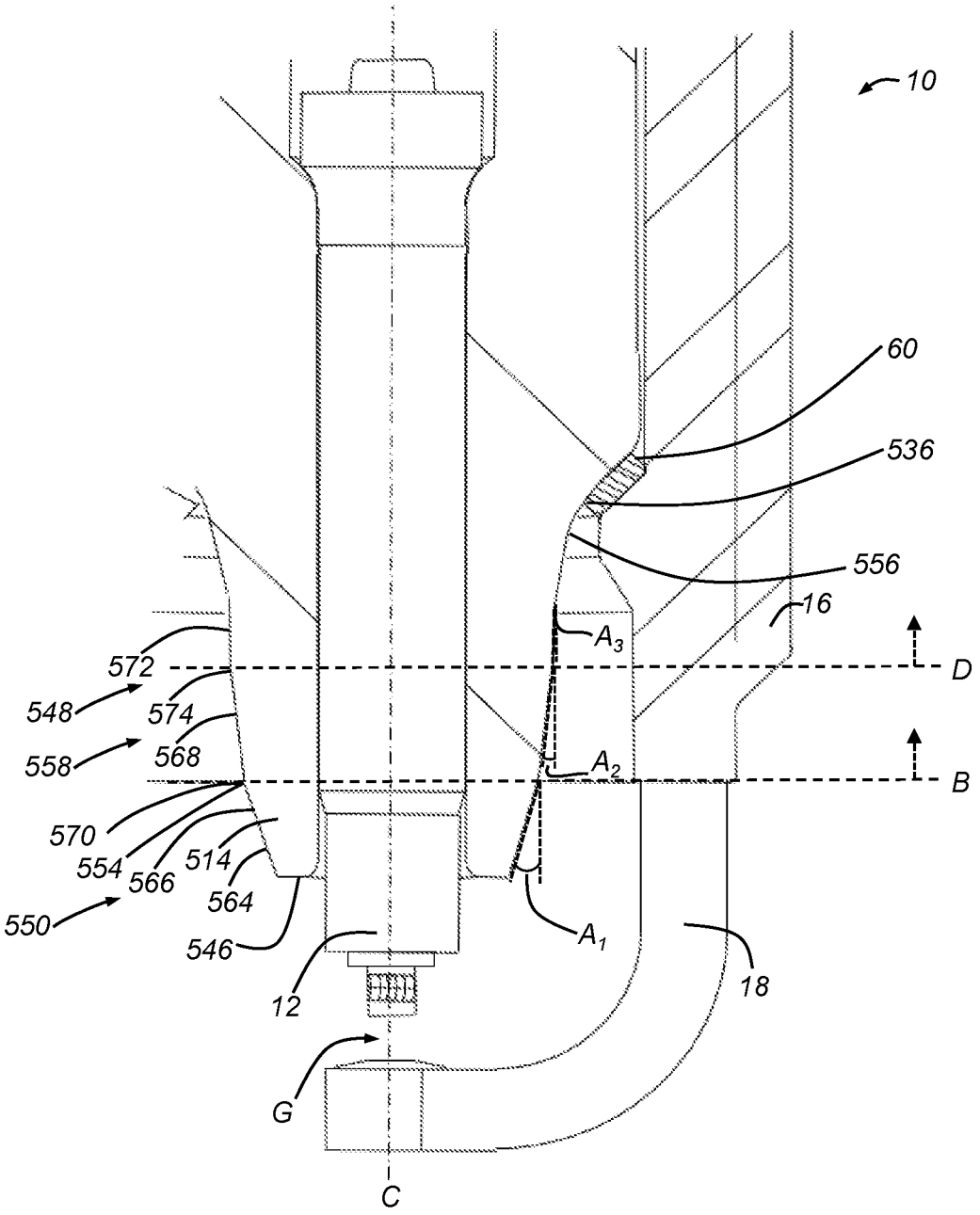
FIG. 7 is a cross-sectional view of a fourth embodiment of a spark plug with an exemplary insulator.

With particular reference to FIG. 7, there is shown an insulator 514 that can be used with the spark plug 10. The insulator 514 includes an unexposed portion 548 and an exposed portion 550. The exposed portion 550 includes a nose tip 546 and an exposed body portion 564. The exposed body portion 564 can be slanted or angled at a first angle $A_1$. The exposed portion 550 lacks (or is formed without) a tip merge portion. However, in other embodiments, a tip merge portion can be included between the nose tip 546 and the exposed body portion 564. The exposed portion 550 includes a first outer surface 566 that is slanted at the first angle $A_1$ (also referred to as an exposed nose angle in this embodiment).

The unexposed portion 548 includes an unexposed body portion 558 and a nose root portion 556. The unexposed body portion 558 includes a second outer surface (or first unexposed surface) 568 and a third outer surface (or second unexposed surface) 572. The second outer surface 568 forms a first nose surface transition 570 at an exposed-unexposed interface 554 with the first outer surface 566. And, the second outer surface 568 forms a second nose surface transition 574 with the third outer surface 572. Thus, the second nose surface transition 574 resides along a plane D that is orthogonal to the central axis C and that is within unexposed portion 548 of the insulator 514. The second outer surface 568 can be a surface of the unexposed portion 548 that is between the exposed-unexposed interface 554 (or the first nose surface transition 570) and the second nose surface transition 574. The third outer surface 572 can be a surface of the unexposed portion 548 that is between the second nose surface transition 574 and a nose root portion 556. In other embodiments, the first nose surface transition 570 can be within the exposed portion 550 such that a surface (at a second angle $A_2$ (also referred to as a first unexposed nose angle in this embodiment)) between the first and second nose surface transitions 570, 574 includes at least part of the unexposed portion 548 and at least part of the exposed portion 550.

The second outer surface 568 can be angled or slanted at the second angle $A_2$ and the third outer surface 572 can be angled or slanted at a third angle $A_3$ (also referred to as a second unexposed nose angle in this embodiment). In one embodiment, such as that which is shown in the depicted embodiment of FIG. 8, the angles of the insulator can be constructed in accordance with: $A_1>A_2>A_3$. And, in a more particular configuration, the third angle $A_3$ can be zero or parallel to the central axis C. In another embodiment, the angles of the insulator can be constructed in accordance with: $A_1>A_3>A_2$. The first nose surface transition 570 and/or the second nose surface transition 574 can include a circumferential vertex (or sharp edge), or can include a rounded or radiused edge, a filet, a chamfer, multiple sharp edges, or the like.

Figure 8:
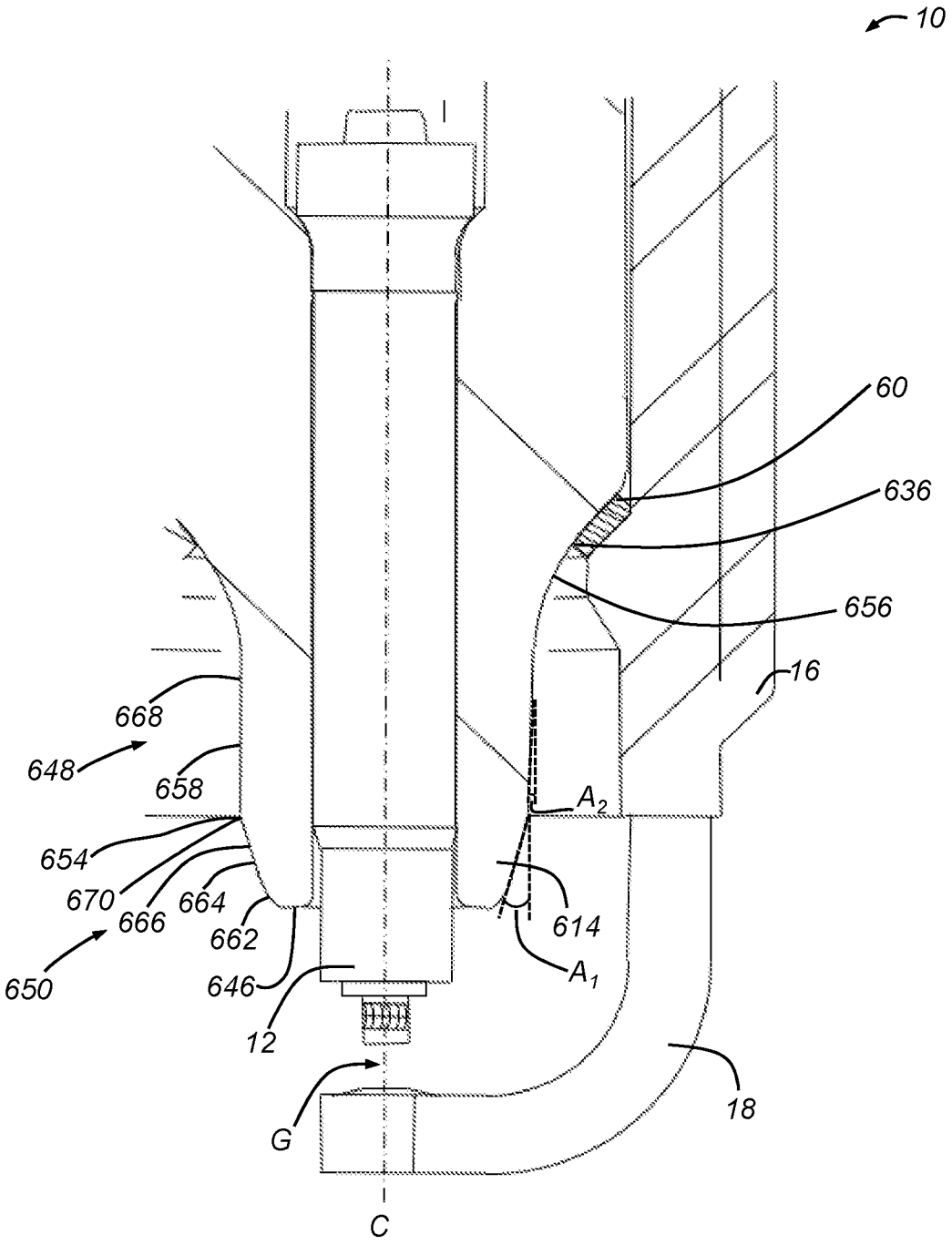
FIG. 8 is a cross-sectional view of a fifth embodiment of a spark plug with an exemplary insulator.

With reference to FIG. 8, there is shown an insulator 614 that can be used with the spark plug 10. The insulator 614 includes an unexposed portion 648 and an exposed portion 650. The exposed portion 650 of the insulator 614 includes a nose tip 646, a tip merge portion 662, and an exposed body portion 664. The tip merge portion 662 includes a rounded or radiused surface that merges the nose tip 646 and the exposed body portion 664. The unexposed portion 648 includes an unexposed body portion 658 that is parallel with respect to the central axis C. Moreover, the unexposed body portion 658 gradually merges into the nose root portion 656, which then merges into the external step 636.

The nose portion 30 includes an exposed-unexposed interface 654 at which a nose surface transition 670 takes place between a first outer surface 666 and a second outer surface 668. The first outer surface 666 can be angled or slanted at a first angle $A_1$ and the second outer surface 668 can be angled or slanted at a second angle $A_2$. It should be appreciated that, at least in the depicted embodiment, the first outer surface 666 coincides with (and, thus, at least partially includes) the exposed body portion 664 and the second outer surface 668 coincides with (and, thus, at least partially includes) the unexposed body portion 658. Thus, in this embodiment, the second outer surface 668 is parallel to the central axis C. However, in other embodiments, the nose surface transition 670 can be disposed within either the unexposed portion 648 or the exposed portion 650. In such cases, the first outer surface 666 or the second outer surface 668 can include the exposed-unexposed interface 654. In the FIG. 8 embodiment, the second outer surface 668 is a continuously curved portion such that the radius continuously varies along this portion of the insulator. Thus, along the second outer surface 668, the second angle $A_2$ can vary continuously from the nose surface transition 670 through the remainder of the core nose portion up past the gasket 60.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation. In addition, the term "and/or" is to be construed as an inclusive OR. Therefore, for example, the phrase "A, B, and/or C" is to be interpreted as covering all of the following: "A"; "B"; "C"; "A and B"; "A and C"; "B and C"; and "A, B, and C."

The invention claimed is:

1. A spark plug, comprising:

a metallic shell;

an insulator at least partially surrounded by the metallic shell;

a center electrode disposed within a bore of the insulator; and a ground electrode attached to the metallic shell;

wherein the insulator includes a first outer surface at least partly along an exposed portion and a second outer surface at least partly along an unexposed portion, the exposed portion includes a portion of the insulator that extends from an exposed-unexposed interface to a tip of the insulator, the first outer surface extends between the exposed-unexposed interface to a tip merge portion adjacent a distal end of the insulator, the first outer surface and the second outer surface meet at a nose surface transition, at the nose surface transition, the first outer surface is disposed at a first angle with respect to a central axis of the spark plug, and the second outer surface is disposed at a second angle with respect to the central axis of the spark plug, the first angle is larger than the second angle, and the nose surface transition is located within the unexposed portion or at the exposed-unexposed interface.

2. The spark plug of claim 1, wherein the second angle is zero such that the second outer surface is parallel to the central axis of the spark plug.

3. The spark plug of claim 2, wherein the second outer surface extends in a parallel fashion for a majority of the unexposed portion.

4. The spark plug of claim 1, wherein the second angle is non-zero such that the first surface forms a first tapered region within the exposed portion of the insulator and the second angle forms a second tapered region within the unexposed portion of the insulator.

5. The spark plug of claim 4, wherein the second outer surface is a variable radius curved surface.

6. The spark plug of claim 4, wherein the insulator includes a third outer surface along the unexposed portion that is angled at a third angle with respect to the central axis of the spark plug, wherein the third angle is not equal to the second angle.

7. The spark plug of claim 6, wherein the third angle is less than the second angle.

8. The spark plug of claim 6, wherein the second angle is less than the third angle and the third angle is less than the first angle.

9. The spark plug of claim 1, wherein a radial distance between the metallic shell and the insulator is greater than or equal to 1 mm and greater than a spark gap formed between the center electrode and the ground electrode, the radial distance being measured along a line that passes through the nose surface transition, the line being orthogonal to the central axis of the spark plug.

10. The spark plug of claim 1, wherein a radial distance between the metallic shell and the insulator is at a maximum when compared to other radial distances taken between the metallic shell and the insulator at the unexposed portion, the radial distance being measured along a line that passes through the nose surface transition and that is orthogonal to the central axis of the spark plug, and the other radial distances being measured along other lines, each of which is parallel to the line that passes through the nose surface transition and that is orthogonal to the central axis of the spark plug.

11. The spark plug of claim 1, wherein a diameter of the insulator decreases as it extends from the unexposed portion to the exposed portion.

12. The spark plug of claim 1, wherein a gap exists between an interior surface of the metallic shell and the insulator at the unexposed portion.

13. The spark plug of claim 1, wherein the nose surface transition is located at the exposed-unexposed interface.

14. The spark plug of claim 1, wherein the nose surface transition has a circumferential vertex.

15. The spark plug of claim 1, wherein the first outer surface is conical between the nose surface transition and the distal end of the insulator.

16. The spark plug of claim 1, wherein the first angle is between 1° and 30°, inclusive.

17. The spark plug of claim 1, wherein the second angle is between 0° and 15°, inclusive.

18. A spark plug, comprising:

a metallic shell;

an insulator at least partially surrounded by the metallic shell;

a center electrode disposed within a bore of the insulator; and a ground electrode attached to the metallic shell;

wherein the insulator includes a first outer surface at least partly along an exposed portion and a second outer surface at least partly along an unexposed portion, the exposed portion includes a portion of the insulator that extends from an exposed-unexposed interface to a tip of the insulator, the first outer surface and the second outer surface meet at a nose surface transition, the first outer surface is conical between the nose surface transition and a distal end of the insulator, at the nose surface transition, the first outer surface is disposed at a first angle with respect to a central axis of the spark plug, and the second outer surface is disposed at a second angle with respect to the central axis of the spark plug, and the first angle is larger than the second angle, and the difference between the first angle and the second angle is between 1° and 20°, inclusive.

19. The spark plug of claim 18, wherein the difference between the first angle and the second angle is between 1° and 10°, inclusive.

20. A spark plug, comprising:

a metallic shell;

an insulator at least partially surrounded by the metallic shell;

a center electrode disposed within a bore of the insulator; and a ground electrode attached to the metallic shell;

wherein the insulator includes a first outer surface at least partly along an exposed portion, a second outer surface at least partly along an unexposed portion, and a third outer surface at least partly along the unexposed portion, the exposed portion includes a portion of the insulator that extends from an exposed-unexposed interface to a tip of the insulator, the first outer surface and the second outer surface meet at a first nose surface transition, and the second outer surface and the third outer surface meet at a second nose surface transition, at the first nose surface transition, the first outer surface is disposed at a first angle with respect to a central axis of the spark plug, and the second outer surface is disposed at a second angle with respect to the central axis of the spark plug, and the first angle is larger than the second angle, and the second nose surface transition is located within the unexposed portion.

* * * * *